US005115380A

United States Patent [19]

Huisingh et al.

[11] Patent Number: 5,115,380

[45] Date of Patent: * May 19, 1992

[54] TASK LIGHT PANEL

[75] Inventors: James H. Huisingh; Edward L. Elzinga, both of Holland, Mich.

[73] Assignee: Herman Miller, Inc., Zeeland, Mich.

[ * ] Notice: The portion of the term of this patent subsequent to Aug. 13, 2008 has been disclaimed.

[21] Appl. No.: 682,091

[22] Filed: May 6, 1991

Related U.S. Application Data

[63] Continuation of Ser. No. 495,371, Mar. 19, 1990, Pat. No. 5,040,104.

[51] Int. Cl.[5] ..... F21V 5/08

[52] U.S. Cl. ..... 362/33; 362/223; 362/330; 362/333

[58] Field of Search ..... 362/223, 260, 309, 330, 362/331, 333, 145, 147, 33

[56] References Cited

U.S. PATENT DOCUMENTS 3,179,796 4/1965 Rolph ..... 362/339
4,054,793 10/1977 Shemitz ..... 362/224
4,071,750 1/1978 Schneppendahl et al. ..... 362/217
4,233,651 11/1980 Fabbri ..... 362/260
4,242,723 12/1980 Fabbri et al. ..... 362/224
4,300,185 11/1981 Wakamatsu ..... 362/225
4,368,504 1/1983 Sato et al. .
4,432,044 2/1984 Lautzenheiser .
4,542,449 9/1985 Whitehead .
4,562,515 12/1985 Lautzenheiser ..... 362/33
4,616,296 10/1986 Westgaard et al. .

*Primary Examiner*—Richard R. Cole
*Attorney, Agent, or Firm*—Varnum, Riddering, Schmidt & Howlett

[57] ABSTRACT

A task light panel for use with a light source for illuminating a work surface. The panel comprises an upper surface having a plurality of transverse grooves formed thereon and a lower surface having a plurality of longitudinal grooves formed thereon. The transverse and longitudinal grooves are substantially perpendicular to each other and are adapted to distribute light from the light source onto the work surface, reduce glare or veiling reflections from the work surface, and block direct viewing of the light source by an individual using the work surface.

2 Claims, 2 Drawing Sheets

TASK LIGHT PANEL

This is a continuation of application Ser. No. 07/495,371 filed Mar. 19, 1990 now U.S. Pat. No. 5,040,104.

BACKGROUND OF THE INVENTION

1. Field of the Invention

The present invention relates to task lighting systems and, more particularly, to an improved means for evenly distributing light with reduced glare over an entire work surface using a single panel having integral lens and diffuser functions.

2. Description of the Related Art

Light from a linear source, such as a conventional fluorescent bulb mounted over a work surface, has an uneven illumination pattern. That is, the light is directed primarily to a center of the work surface, with greatly reduced illumination of the front, rear and sides of the work surface. Typically, a lens is employed to provide more uniform illumination across the work surface from one side to the other.

Strong coherent illumination also produces considerable glare off the work surface. Glare is undesirable because it causes fatigue, eye strain, and reduced user efficiency. In addition, direct light or glare from the bulb, such as caused by the user viewing the bulb, is very distracting and can cause fatigue.

Oftentimes a separate frosted diffuser sheet is employed to reduce glare by dispersing and attenuating light emanating from the light source. Frosted diffusers randomly diffuse light, thereby reducing glare or veiling reflections. However, because frosted diffusers randomly diffuse the light without attempting to focus it, they fail to adequately and uniformly illuminate the work surface from front to rear. Moreover, although frosted diffusers can prevent the user from viewing the bulb, a substantial amount of light still impinges on the user's eyes directly from the bulb. Further, the light is still reflected from a work surface to a user's eyes even though the light is diffused and attenuated.

Some diffusers employ prismatic refractors in an attempt to reduce glare and disperse light. An example of such an arrangement is disclosed in U.S. Pat. No. 4,233,651, issued Nov. 11, 1980 to W. Fabbri which discloses a lower refractor plate that is slidable laterally relative to an upper refractor plate. While light is dispersed toward opposite side portions of the work surface when the lower refractor plate is centered relative to the upper plate, only the central portion of the work surface is provided with glare-free light. The Fabbri structure is not adapted to prevent light from the source from directly impinging on the user's eyes or to prevent the source from being viewed by the user. The user can still view end portions of the light source. Further, the upper refractor plate increases the cost of the diffuser substantially.

U.S. Pat. No. 4,300,185 issued Nov. 10, 1981 to J. Wakamatsu discloses a structure in which the lighting fixture must be positioned above the front edge of the work surface. A control lens includes a plurality of pyramidal indentations formed adjacent to a front edge of and on an upper surface of the lens, the indentations being adapted to disperse light. The remainder of the upper surface is covered by a plurality of longitudinally extending linear indentations of nonuniform depth. However, the disclosed embodiments do not block direct viewing of the light source by a user or prevent light from directly impinging on the user's eyes.

Thus, there is a need for an improved task light panel that evenly disperses light over a work surface, reduces glare from the work surface, and effectively blocks the user's direct view of the light source. It would be advantageous if a single panel having these capabilities could be provided as this would reduce the production and assembly costs of a task lighting system.

SUMMARY OF THE INVENTION

The invention relates to a task light panel for use in conjunction with a light source for illuminating a work surface The panel includes an upper surface having a plurality of first grooves formed thereon and a lower surface having a plurality of second grooves formed thereon. The first and second grooves are substantially perpendicular to one another and are adapted to distribute light from the light source onto the work surface.

The first grooves are formed on substantially the entire upper surface of the task light panel and are substantially symmetrical. Preferably, the first grooves form angles of approximately 40° with respect to a line perpendicular to a face of the task light panel. The first grooves are adapted to substantially uniformly illuminate the work surface between the side edges thereof.

The second grooves are formed on a portion of the lower surface adjacent to a front edge of the panel and occupy approximately one-half the surface area of the task light panel lower surface. Preferably the second grooves are asymmetrical and form first and second angles with respect to a line perpendicular to a face of the panel. Preferably, the first angle is approximately 60° and the second angle is approximately 10°. The second grooves are adapted to direct light from the light source toward a rear edge of the work surface. The first grooves overlie the second grooves and cooperate with the second grooves to reduce glare or veiling reflections on the work surface as well as to block direct viewing of the light source by an individual using the work surface.

The invention also relates to a lighting fixture comprising a housing having an open bottom portion in which is received a light source, the housing being adapted to receive in the open bottom portion a task light panel constructed according to the invention. The invention further relates to a work station in which a work surface and a storage module are mounted to a wall panel. A lighting fixture incorporating a task light panel constructed according to the invention can be mounted to the underside of the storage module to illuminate the work surface below.

BRIEF DESCRIPTION OF THE DRAWINGS

For a more complete understanding of the invention reference should now be had to the accompanying drawings in which.

DETAILED DESCRIPTION OF THE PREFERRED EMBODIMENTS

Figure 1:
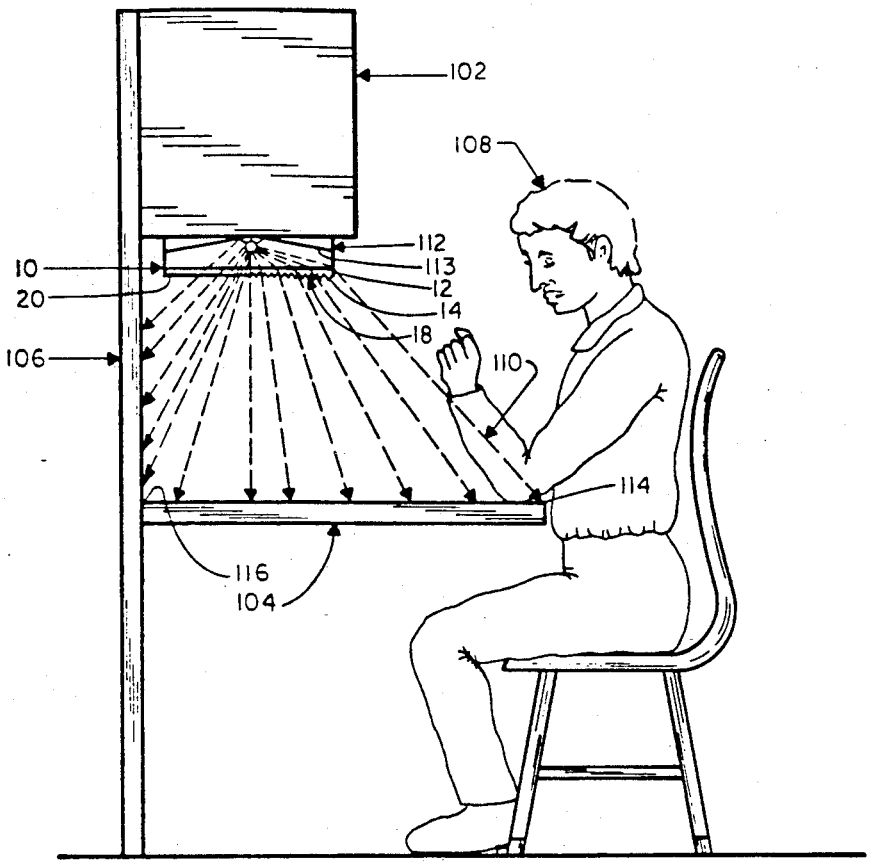
FIG. 1 is a side elevational view of an office work station incorporating a task light panel according to the invention.
Figure 2:
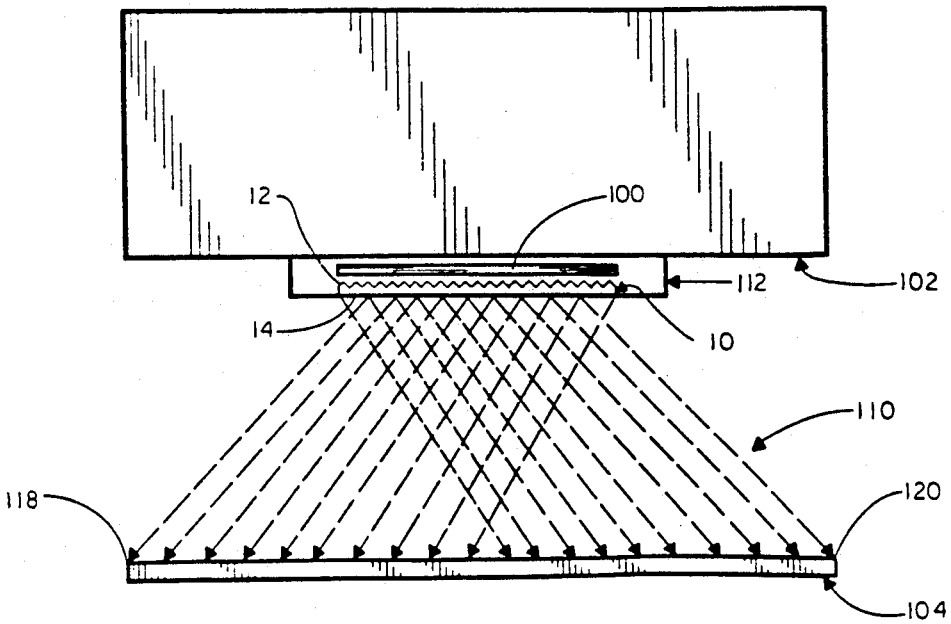
FIG. 2 is a front elevational view of an office work station incorporating the task light panel of FIG. 1.

Referring now to FIGS. 1 and 2, the task light panel is designated generally by the reference numeral 10 and is shown incorporated into a typical office work station 110. The work station 110 can form a part of a modular office arrangement of the open plan type that uses free-standing wall panels to segment space or can be provided in conjunction with a conventional office having structural partitions to which wall panels are mounted. Hanging components such as work surfaces, storage cabinets and shelves can be mounted to the wall panels in cantilevered fashion to furnish the work station 110.

FIGS. 1 and 2 show a work surface 104 and a storage module 102 such as a cabinet or shelf mounted to a wall panel 106 to furnish the work station 110. Task lighting is provided by a light fixture 112 mounted to an underside of the cabinet or shelf. Typically, the work surface 104 is rectangular with a longitudinal axis (not shown separately in the drawings) extending between a left side edge 118 of the work surface and a right side edge 120 of the work surface. The work surface further includes front and rear edges, respectively designated 114 and 116. For reference, the front edge 114 is that edge of the work surface which is typically adjacent a user 108 of the work surface. In the embodiment shown in FIG. 1, the work surface is cantilevered from the wall panel 106 so that the rear edge 116 thereof is adjacent to the wall panel. The work surface thus will have a front portion thereof extending toward the user 108 and a rear portion extending away from the user. Preferably, the fixture 112 is a sheet metal structure open at the bottom and having a linear light source 100 mounted therein. The fixture 112 includes means for mounting the task light panel 10. The task light panel 10 is mounted to the fixture 112 such that the task light panel is interposed between the light source 100 and the work surface 104. The light source 100 is, in the preferred arrangement, an elongated cylindrical element such as a conventional fluorescent T-12 bulb having a longitudinal axis (not shown separately in the drawings) parallel to the longitudinal axis of the work surface 104. An inside surface 113 of the fixture 112 is generally adapted to reflect light onto the work surface 104. As explained more fully below, the task light panel 10 directs light laterally across the work surface 104 (FIG. 2) and also away from eyes of a user 108 and onto the work surface (FIG. 1).

Figure 3:
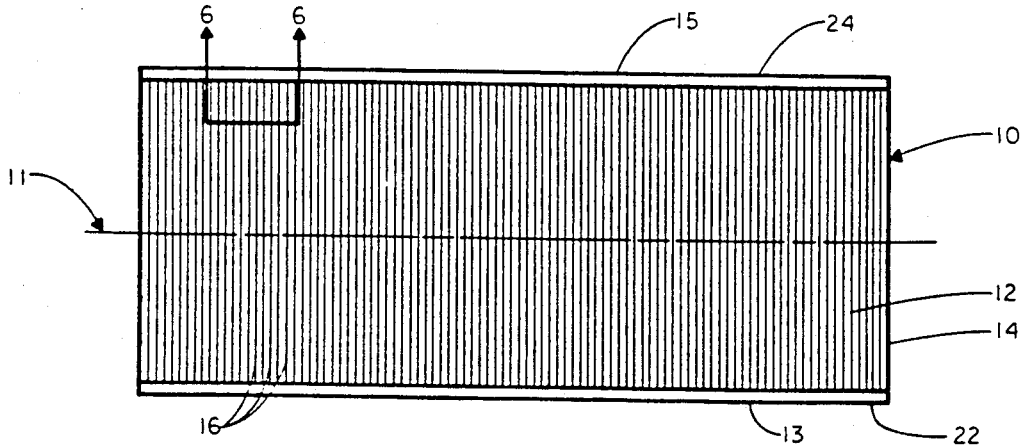
FIG. 3 is a top plan view of the task light panel of FIGS. 1 and 2.
Figure 4:
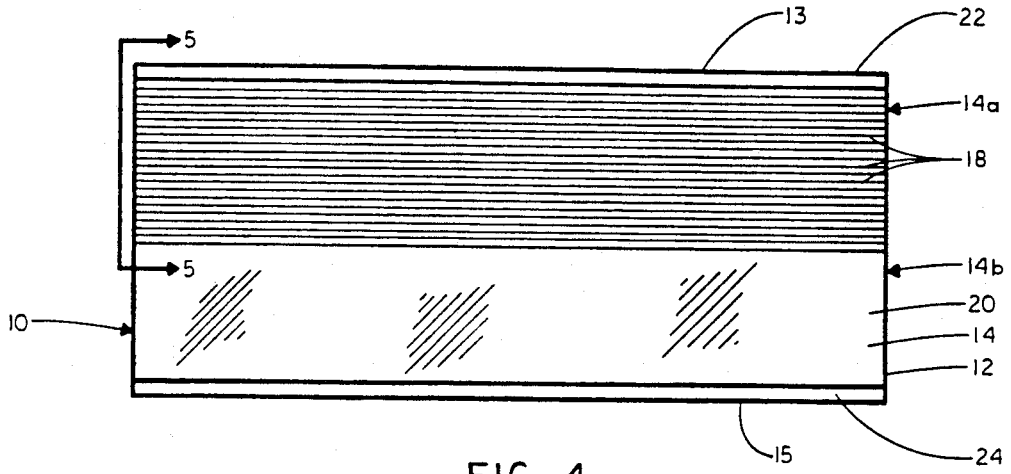
FIG. 4 is a bottom plan view of the task light panel of FIGS. 1 to 3.
Figure 5:
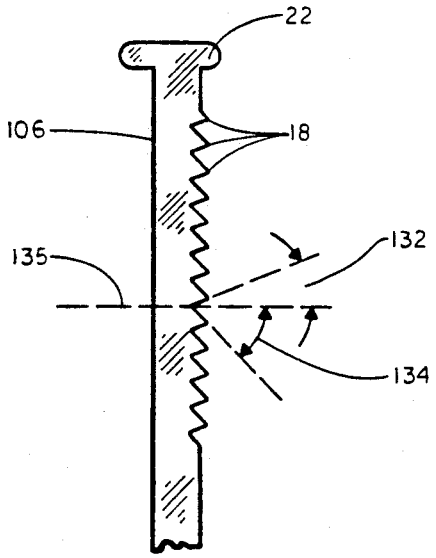
FIG. 5 is an enlarged, fragmentary, side elevational view taken generally along lines 5—5 of FIG. 4.

FIGS. 3 to 5 illustrate the structure of the task light panel 10 in greater detail The panel 10 is a generally rectangular, unitary sheet or member formed of a clear, light transmitting plastic such as acrylic. The panel 10 is horizontally mounted to the fixture 112 with a panel longitudinal axis 11 parallel to the longitudinal axes of the light source 100 and the work surface 104. The task light panel 10 includes an upper, light source facing surface 12 and a lower, work surface facing surface 14. A front lip 22 is formed along a front, user facing edge 13 of the task light panel 10. Similarly, a rear lip 24 is formed along a rear edge 15 of the panel 10. The front and rear lips 22, 24 provide rigidity to the panel 10 and can be used to mount the task light panel to the fixture 112.

Figure 6:
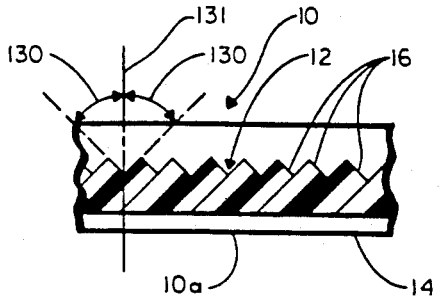
FIG. 6 is a sectional view of the task light panel taken generally along lines 6—6 of FIG. 3.

A plurality of substantially symmetrical transverse (or first) grooves 16 are formed on substantially the entire upper surface 12 of the panel 10, the grooves extending transversely to the longitudinal axis 11 of the task light panel. As best shown in FIG. 6, each groove 16 is prismatic in shape and is adapted to direct light from the light source 100 laterally across the work surface 104 (FIG. 2), thereby uniformly illuminating the work surface between the right and left work surface edges 118, 120. Thus, it will be seen that the structure formed between the grooves 16 are prisms which refract light from the light source as it passes through the panel 10. The degree of refraction depends upon the slope of the prism side or, conversely, the angle of the grooves. An optimum angle 130 for the transverse grooves 16 will vary depending upon the application for the panel 10; the material of construction for the panel; the configuration of the light source 100, the task light panel 10, and the fixture 112; and the position of the fixture with respect to the work surface. The angle 130 is preferably approximately 40 degrees with respect to a vertical center line (identified schematically by the reference numeral 131) perpendicular to a face 10*a* of the task light panel 10.

As best shown in FIGS. 4 and 5, the panel 10 further includes a plurality of asymmetrical longitudinal (or second) grooves 18 on a front portion 14*a* of the panel lower surface 14, and a smooth, grooveless section 20 on a rear portion 14*b* of the panel lower surface. The longitudinal grooves 18 extend parallel to the panel longitudinal axis 11 and occupy approximately one-half the lower surface depth, that is, the dimension extending between the panel front and rear edges 13, 15, respectively. (It will be understood that the longitudinal axis 11 of the panel 10 is identified principally for the purpose of describing the relative orientations of the transverse grooves 16 and the longitudinal grooves 18.) The area covered by the grooves 18 can be adjusted to adapt to particular needs. Each groove 18 is prismatic in shape and, as best shown in FIG. 1, is adapted to direct light emanating from the light source 100 away from the eyes of the user 108 and onto the work surface 104. As with the grooves 16 and prisms on the upper surface 12, so the grooves 18 define prisms on the lower surface 14 which refract light from the light source. The asymmetry of the grooves 18 means that opposite sides of the prisms will have different slopes. Thus, light will be refracted at different angles on the opposed sides of each prism. As can be seen in FIG. 5, each longitudinal groove 18 has a longitudinal groove front angle 132, which is significantly less than a longitudinal groove rear angle 134. The optimum dimension for the longitudinal groove front angle 132 and the longitudinal groove rear angle 134 will vary depending upon the application; the material of construction; the configuration of the light source 100, the task light panel 10, and the fixture 112; and the position of the fixture with respect to the work surface 104. Preferably, the longitudinal groove front angle 132 is approximately 10 degrees with respect to a vertical center line (identified schematically by the reference numeral 135) perpendicular to a face 10*b* of the panel and the longitudinal groove rear angle 134 is approximately 60 degrees with respect to the vertical center line.

As an example of a preferred embodiment, a task light panel having a dimension of approximately 44.5" in the longitudinal direction and a dimension of approximately 6.2' in the transverse direction is used in conjunction with a conventional T-12 fluorescent light source having a length or longitudinal dimension of approximately 36". The light source and task light panel are mounted to the underside of a storage cabinet and over a work surface. The work surface has a depth or transverse dimension of approximately 30", the light source is positioned approximately 8.6" from the work surface rear edge, and the panel is mounted in the range of 16.75" to 25.25" above the work surface.

In operation, the task light panel 10 performs several functions. The transverse grooves 16 on the upper surface 12 act as prismatic lenses to direct light toward the left and right work surface edges 118, 120 so that illumination of the work surface 104 is substantially uniform along the work surface longitudinal axis and glare to the user is avoided. The longitudinal grooves 18 on the lower surface 14 also act as prismatic lenses. They function principally to refract light from the source 100. In the absence of the grooves 18, illumination from the light source 100 would impinge directly on the eyes of the user 108 and would fall on the work surface 104 adjacent to the front edge 114 thereof. Thus, the longitudinal grooves 18 cooperate with the overlying transverse grooves 16 to provide increased illumination of the work surface 104 between the front and rear edges 114, 116. The grooves 16 and the grooves 18 also coact to block direct viewing of the light source 100 by the user 108. Thus the grooves 16 and the grooves 18, although forming independent prismatic lenses, cooperate synergistically to provide a diffuser function. It can be seen that a single task light panel that functions to uniformly illuminate a work surface between the side, front, and rear edges thereof has been provided. The panel further provides a diffuser function by reducing glare or veiling reflections from the work surface and blocking a user's direct view of the light source.

Reasonable variations or modifications are possible within the spirit of the foregoing specification and drawings without departing from the scope of the invention which is defined in the accompanying claims.

The embodiments of the invention in which an exclusive properly or privilege is claimed are defined as follows:

1. In combination, a work station having a work surface illuminated by a light source, and a panel interposed between the light source and the work surface for distributing light onto the work surface, said work surface including front and rear edges and opposed side edges, said panel comprising a first surface and a second surface; and a plurality of like asymmetrical first prisms on the panel first surface substantially parallel to the front edge; and a plurality of asymmetrical second prisms on the second surface substantially parallel to a side edge;

said second prisms being substantially perpendicular to the first prisms;

said panel being positioned adjacent the light source and away from the work surface a sufficient distance so that the prisms will refract light from the light source substantially toward the area bounded by the front, rear, and side edges for uniform illumination of the work surface and away from the area outside the work surface.

2. A work station according to claim 1 wherein the side edges are approximately 30 inches in length and the panel is positioned away from the work surface in the range of 16.75 inches to 25.25 inches away from the work surface.

* * * * *

UNITED STATES PATENT AND TRADEMARK OFFICE

CERTIFICATE OF CORRECTION

PATENT NO. : 5,115,380

DATED : May 19, 1992

INVENTOR(S) : JAMES H. HUISINGH ET AL

It is certified that error appears in the above-identified patent and that said Letters Patent is hereby corrected as shown below:

Col. 6, Claim 1, Line 18, "asymmetrical" should be --symmetrical--.

Signed and Sealed this

Twentieth Day of July, 1993

*Attest:*

Michael K. Kirk

MICHAEL K. KIRK

*Attesting Officer*

*Acting Commissioner of Patents and Trademarks*